United States Patent [19]

Terzian

[11] 4,294,033

[45] Oct. 13, 1981

[54] ANIMATED TALKING DOLL

[75] Inventor: Rouben T. Terzian, Chicago, Ill.

[73] Assignee: Marvin Glass & Associates, Chicago, Ill.

[21] Appl. No.: 10,936

[22] Filed: Feb. 9, 1979

[51] Int. Cl.[3] ..... A63H 5/00; A63H 11/00; A63H 2/28

[52] U.S. Cl. ..... 46/118; 46/135 R; 46/186

[58] Field of Search ..... 46/118, 117, 44, 135 R, 46/141, 171, 186, 183–185, 187

[56] References Cited

U.S. PATENT DOCUMENTS

| | | | |
|---|---|---|---|
| 1,805,231 | 5/1931 | Blaustein | 46/118 |
| 2,537,157 | 1/1951 | Petrov | 46/186 |
| 2,667,718 | 2/1954 | Wilhelm | 46/187 |
| 2,689,432 | 9/1954 | Beebe | 46/118 |
| 3,093,928 | 6/1963 | Ostrander | 46/186 |
| 3,186,126 | 6/1965 | Ostrander | 46/118 |
| 3,195,268 | 7/1965 | Neumann et al. | 46/118 |
| 3,208,183 | 9/1965 | Neumann | 46/185 |
| 3,230,664 | 1/1966 | Bornn et al. | 46/118 |
| 3,293,794 | 12/1966 | Ryan | 46/118 |
| 3,303,605 | 2/1967 | Henry | 46/118 |
| 3,376,665 | 4/1968 | Heller | 46/187 |
| 3,413,756 | 12/1968 | Gardel et al. | 46/187 |
| 3,421,254 | 1/1969 | Ryan | 46/118 |
| 3,473,260 | 10/1969 | Kripak et al. | 46/118 |
| 3,583,093 | 6/1971 | Glass et al. | 46/117 |
| 3,881,275 | 5/1975 | Baulard-Cogan | 46/118 |
| 4,177,589 | 12/1979 | Villa | 46/118 |

*Primary Examiner*—Gene Mancene
*Assistant Examiner*—Michael J. Foycik
*Attorney, Agent, or Firm*—Mason, Kolehmainen, Rathburn & Wyss

[57] ABSTRACT

An animated talking doll includes a doll torso and head which includes a facial portion manufactured of generally flexible material. A sounding mechanism within the doll provides various audible sounds to be produced as desired by the user. A manually operative drive mechanism is connected to the mouth area of the facial portion of the doll head for automatically moving parts of the face in a timed relationship to provide coordinated movement of the parts of the face with the sound produced by the sounding mechanism. A clutch mechanism permits operation of the sounding mechanism while not engaging the driving mechanism to provide operation of the sounding mechanism independently of the movement of the facial portion.

2 Claims, 9 Drawing Figures

ANIMATED TALKING DOLL

BACKGROUND OF THE INVENTION

1. Field of the Invention

This invention relates to dolls, and in particular, to an improved animated talking doll.

2. Brief Description of the Prior Art

Many dolls and figure toys have been proposed in the past which have the ability to produce sound from an internal sounding mechanism or other transcribing device, such as a tape recorder. In addition, other dolls have been proposed which are capable of performing various human functions such as walking, sitting, or the like. The present invention is directed to an articulated talking doll which is capable of producing realistic audible sounds or messages during a coordinated movement of the facial features and lips of the doll. Some prior art dolls such as that shown in U.S. Pat. Nos. 3,685,200 and 3,293,795 were designed to produce an animated talking doll where the lips or mouth of the doll were moved in a manner in an attempt to simulate actual talking. However, these and other prior art dolls were extremely complex and therefore expensive to manufacture as well as being unreliable in use. The present invention contemplates the provision of an animated talking doll which is less complex and expensive, and in addition, more reliable in use.

SUMMARY OF THE INVENTION

An object of the present invention is to provide a new and improved animated talking doll which, while producing intelligible, audible sounds, provides coordinated movement of the mouth and related parts of the face.

In accordance with the above and other objects, the present invention provides an animated talking doll which includes a doll torso, limbs and a head. The head of the doll includes a facial portion manufactured of generally flexible material including eyes, nose and a mouth. A sounding mechanism within the doll head is connected to the upper and lower lips of the mouth and is capable of producing various audible sounds at the direction of the user. The sounding mechanism operates on the passage of air through a reed or other known sounding device to produce a "mama" sound in one mode or to produce a humming or "purring" sound in a second mode. The torso of the doll is manufactured in a generally one-piece sealed construction and, upon deformation of the torso, the reduced volume causes compressed air to be directed to the sounding mechanism. A manually operable drive means is connected to the sounding mechanism for automatically moving parts of the face to provide a coordinated movement of the lips and face of the doll in accordance with the sound generated. A disengagement mechanism permits operation of the sounding mechanism without movement of the lips to operate the doll in its second mode to produce a humming or "purring" sound.

BRIEF DESCRIPTION OF THE DRAWINGS

FIG. 9 is a partially fragmented, perspective view of the sounding means utilized in the doll of FIG. 2.

DESCRIPTION OF THE PREFERRED EMBODIMENT

Figure 1:
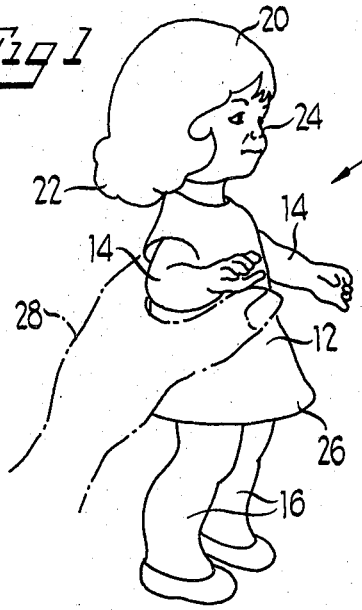
FIG. 1 is a perspective view, on a reduced scale, of a doll made in accordance with the concepts of the present invention.
Figure 2:
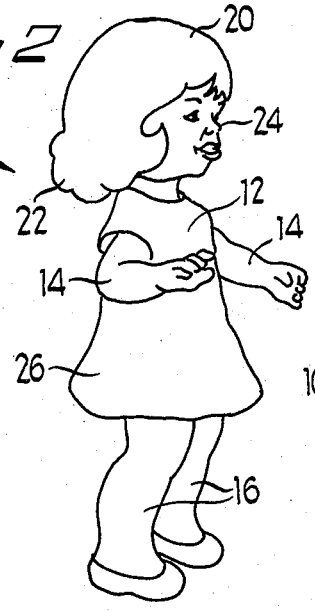
FIG. 2 is a perspective view showing the same doll with its mouth in an open position.

An animated talking doll, generally designated 10, made in accordance with the concepts of the present invention is shown in FIGS. 1 and 2. The doll includes a main torso portion 12 having a pair of arms 14, legs 16 and a head 20. The head, as conventionally done in the art, includes a wig or other covering 22 and a face portion 24 as shown having a pair of eyes, nose and a mouth. The doll 10 is shown in FIG. 1, in a generally standing position, with the hand of a user 28 (shown in phantom) applying a squeezing pressure to the mid-torso portion of the doll. FIG. 1 shows the mouth of the doll in its first or closed position, and then, after squeezing of the torso, FIG. 2 shows the mouth of the doll in its second or open position. As shown, the particular doll illustrated is representative of a girl or female and includes an outer garment, such as a dress 26.

The doll 10 is animated so that its mouth can be opened and closed, as described above, and includes a sounding means, generally designated 30 in FIG. 9, which produces various audible sounds upon the direction of the user. In particular, in one mode of operation, the sounding mechanism produces a "mama" sound when actuated. Along with the production of the "mama" sound, a drive mechanism generally designated 34 in FIGS. 3 and 4, causes the lips of the doll to move in a coordinated relationship so as to open and close simultaneously with the production of the "mama" sound. In its second mode of operation, the drive mechanism is disengaged and therefore does not move the lips in a coordinated pattern but the sounding means 30 is operated to produce a humming or "purring" sound.

Referring to FIGS. 3-6, the sounding means 30 is mounted within the hollow head 20, generally in the center thereof. The head 20 is mounted to the torso by a cylindrical ring 32 which carries at its lower edge an outwardly directed flange 36. At the two sides of the head, generally below the ears, the ring 32 includes, on each side, an inwardly directed journal 38 which engages a shaft or outwardly directed protrusion 40, on each side, for supporting the head for generally forward and reverse pivotal movement. The shaft portions 40 are secured to a downwardly directed cylindrical flange portion 42 of a flat, torso cap or closing plate 44. The plate 44 and cylindrical flange 42 are secured by suitable means such as glue or the like to a neck portion 46 of the torso to provide a one-piece, head mounting structure. The drive mechanism 34 is mounted within a circular aperture 50 in the plate 44 and the neck 46 of the doll. The sounding means 30 is mounted on top of the drive mechanism as shown in FIGS. 3-6.

Figure 5:
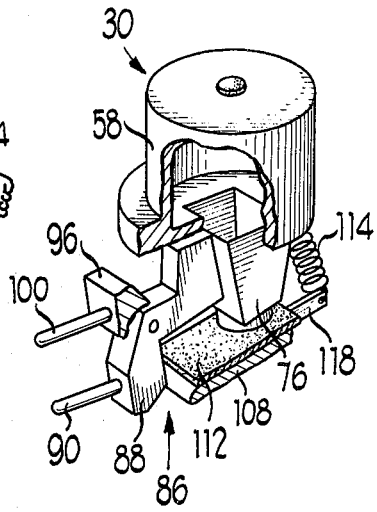
FIG. 5 is another vertical section taken generally along line 5—5 of FIG. 3.
Figure 4:
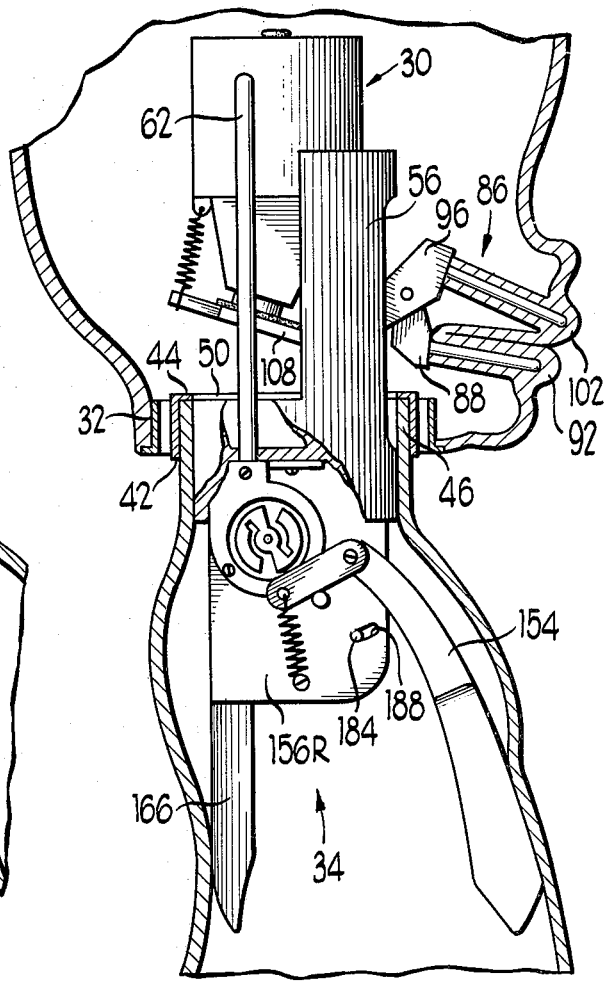
FIG. 4 is another vertical section taken generally along line 4—4 of FIG. 3.
Figure 5:
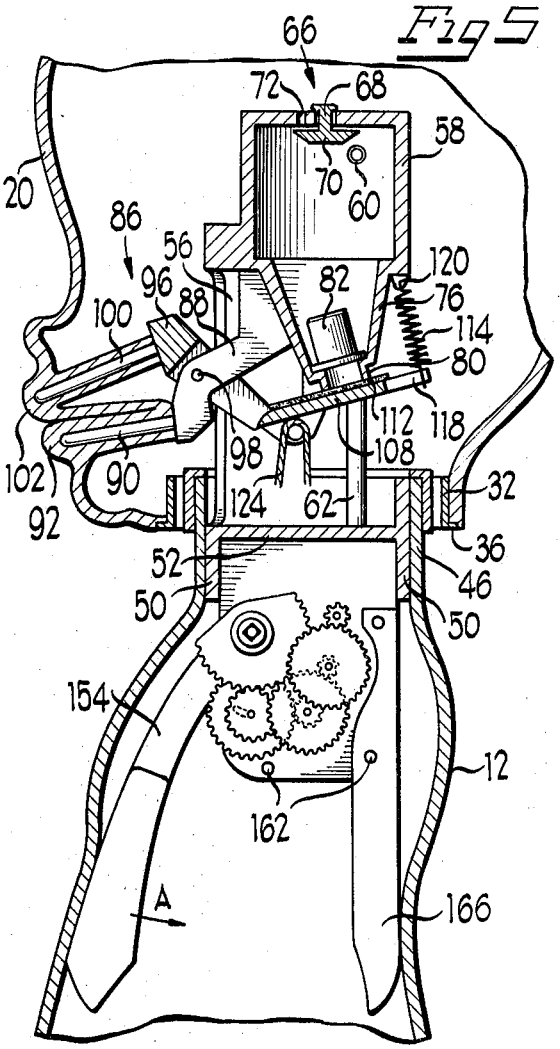
Figure 6:
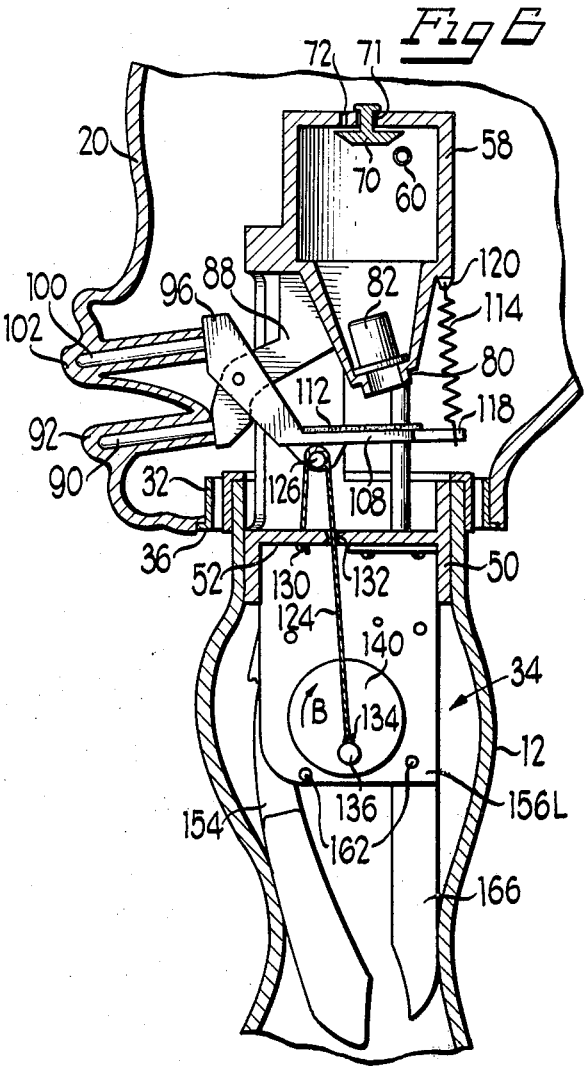
FIG. 6 is yet another vertical section, showing the actuator crank in its second position, taken generally along line 6—6 of FIG. 3.

The drive means 34 and sounding means 30 are supported within the neck 46 by a cylindrical ring 50 and a horizontal plate 52. The ring 50 and plate 52 serve to cap off the upper end or neck of the torso so that the torso 12 which is made of soft pliable material can be compressed, between the positions as shown in FIGS. 5 and 6, to provide a pressurized air source for operating the sounding means 30 as described below. An upwardly directed semi-circular flange or support 56 extending approximately about the front third of the plate 52 extends upwardly as shown in FIGS. 4 and 5 and is integrally formed with an air chamber or cylinder 58 at the top thereof. The chamber 58 has an air inlet 60 from an air inlet tube 62 which extends through the closing plate 52 in communication with the closed cavity formed by the torso as described previously. Therefore, air is supplied to the chamber 58 by compressing the torso which forces air through the inlet tube 62. A valve, generally designated 66, is provided to equalize pressure after release of the torso 12. The valve 66 includes a flexible or rubber plunger 68 which is vertically movable within a journal 70 provided in the top center of the chamber 58. An internal valve head 70 is provided with a sufficient diameter so as to overlap a pressure equalization inlet 72 so that, when compressed air fills the chamber 58, the plunger 68 moves upwardly to close off the inlet 72 and operate the sounding mechanism as will be described in detail hereinafter. When the torso is released, the suction or low pressure generated by the natural tendency of the torso to assume its previous shape draws the plunger downwardly and thus draws air in through the pressure equalization inlet 72 which then passes through the inlet 60 and inlet tube 62 to permit the torso to assume its non-biased condition.

The sounding means 30 further includes a downwardly directed, converging funnel portion 76 which terminates in a generally circular sound emanating orifice 80. A vibratory reed or other sound generating device 82 is placed within the sound emanating orifice 80 to cause sound to be generated as air passes through the reed 82. Thus, a humming or purring sound can be produced by passing pressurized air through the reed when the drive means is in its position as shown in FIGS. 4 and 5.

One object of the present invention is to provide a doll which is capable of saying "mama" while moving its lips in a coordinated fashion. To this end, a lip moving means, generally designated 86, is provided to move the lips in this fashion. The lip moving means 86 includes a stationary pivot arm 88 which is secured to and may even be integrally molded with the front wall of the funnel portion 76 as shown in FIGS. 5 and 6. The forwardmost end of the pivot arm 88 carries a lower lip arm 90 which is embedded in the lower lip 92 of the doll's mouth as can be seen in the drawings. A pivoted arm 96 is pivotally secured by a pin 98 to the arm 88 for movement relative thereto. The pivoted arm 96 includes a similar, forwardly directed post 100 which is embedded in the upper lip 102 as shown. Thus, pivoting of the pivoted arm 96 relative to the pivot arm 88 will cause the upper lip and thus the mouth to move from its closed position as shown in FIG. 5 to its open position as shown in FIG. 6. The movement of the lips and the flexible portions of the face adjacent the lips is controlled by the drive means 34 which is described in detail below. The pivoted arm 96 includes a generally flat or horizontal rearwardly extending portion 108 which lies generally below the sound emanating orifice 80 as shown. A resilient pad 112 is mounted on the extension 108 and engages and thereby closes off the sound emanating orifice 80 when the mouth or lips are in their closed position as shown in FIG. 5. During movement of the mouth or lips to the open position as shown in FIG. 6, the resilient pad 112 is carried downwardly away from the orifice 80 as shown. A spring 114 is secured between a rearwardly extending tab 118 and a mounting flange 120 on the bottom of the chamber 58 to constantly urge the lips to their closed position and to urge the resilient pad 112 into engagement with the sound emanating orifice. Therefore, in actual operation, to produce the "mama" sound of the doll, pressurized air is applied to the chamber 58 and thereby across the reed 80 while simultaneously, the lips are moved, once, to an open position (FIG. 6) producing the first syllable "ma" after which the lips are again closed and opened a second time to produce the second syllable "ma". Thus, the doll speaks the word "mama" while opening and closing its lips two times in a coordinated movement in time with the sound production. Note that the first syllable "ma" is provided as the lips open the first time and the pad 112 is moved away from the sound emanating orifice 80 the first time and the second "ma" is produced after the lips open a second time and the pad 112 is moved away from the sound emanating orifice 80 a second time.

Figure 3:
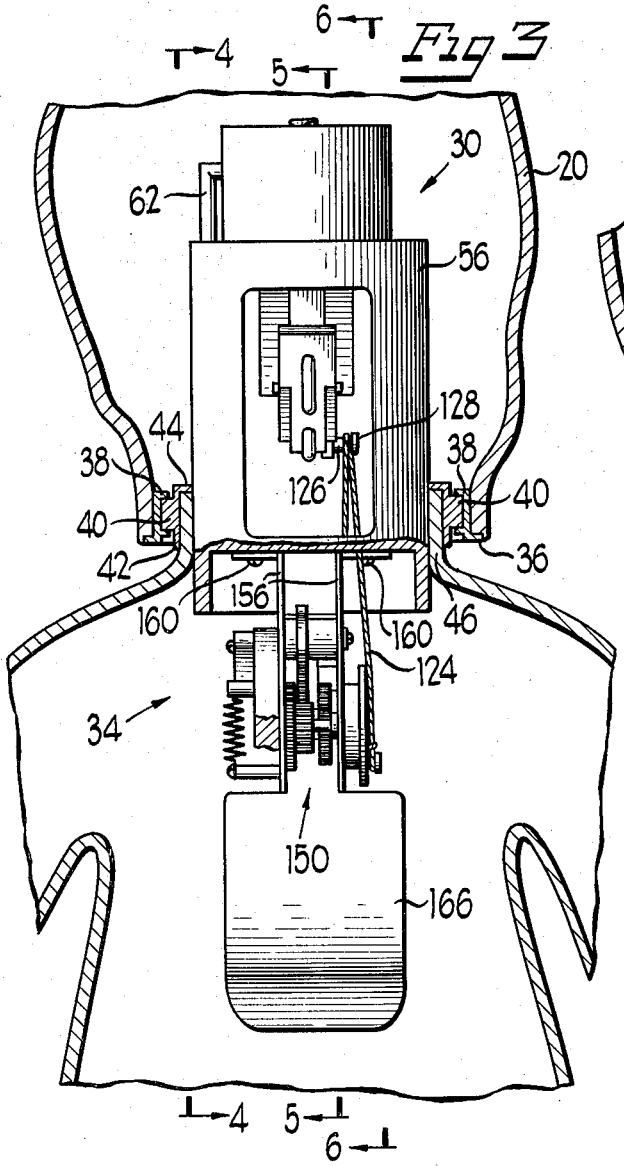
FIG. 3 is a partially fragmented, vertical section, taken generally along line 3—3 of FIG. 2.

In one form of the invention as contemplated by the embodiment shown in the drawings, the actuation of the lip moving means 86 is caused by a flexible wire or string 124 interconnected between the drive means 34 and the pivotal arm 96. More particularly, the string 124 is looped over a horizontal pin or stud 126 which, as shown in FIG. 3, includes an enlarged end cap 128 which prevents the string 124 from sliding off of the edge of the pin 126. One end of the string 124 is secured to the plate 52 as by a knot 130 on the underside of the plate 52, after the string has passed through a small aperture. The other end of the string is passed through a similar aperture 132 and secured by a loop 134 (FIG. 7) to a similar shouldered shaft 136 secured to an output drive wheel 140 at a position remote from the rotating axis of the wheel 140. The output drive wheel 140 starts in a position, generally at the uppermost point in its travel, permitting the mouth to assume a closed position as shown in FIG. 5. The output wheel 140 then rotates through an angle of approximately 540° or $1\frac{1}{2}$ times, first to move the pin 136 to its lowermost position, as shown in FIG. 6, causing the mouth to open, and then an additional 360° to cause the mouth to close and then open a second time. As described above, this produces the two-cycle opening of the mouth while the pressurized air produces the "mama" sound output.

Figure 7:
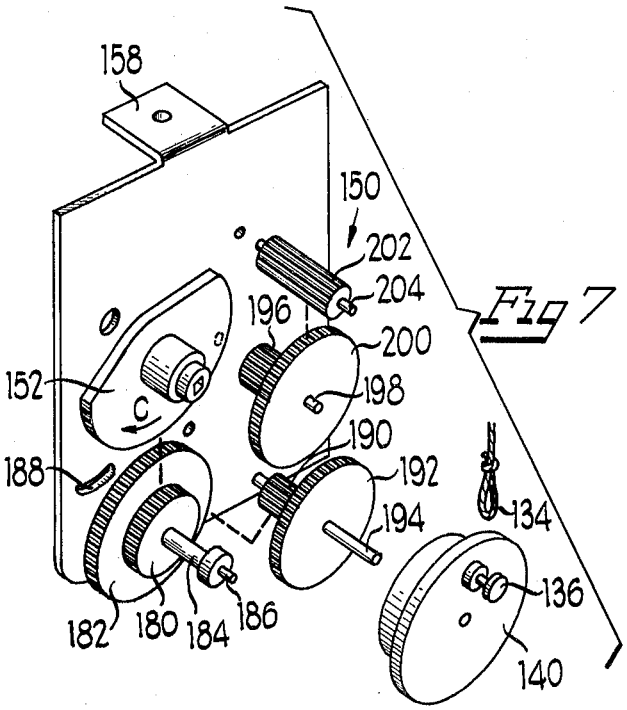
FIG. 7 is an exploded perspective view of the drive mechanism shown in the doll of FIG. 5.

The gear train, generally designated 150, shown in an exploded view in FIG. 7, rotates the output drive wheel 140 as described above. The gear train 150 is mounted between two generally flat depending plates 156 which are secured to the underside of the plate 52 by a pair of outwardly directed flanges 158 and screws 160. For added rigidity, the bottom of the plates may be connected to one another, as is conventionally done, by one or more connecting pins 162.

Figure 8:
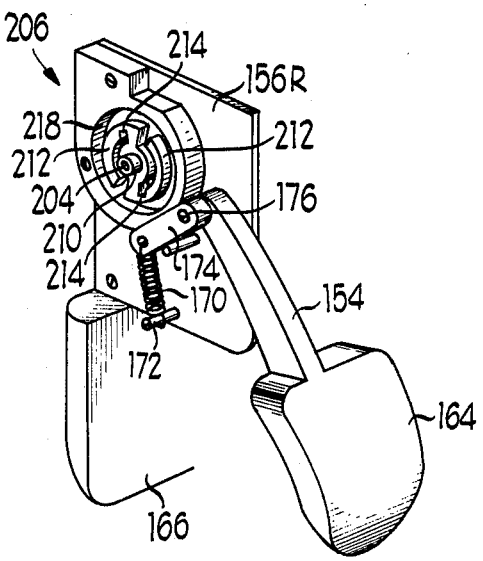
FIG. 8 is another perspective view of the governor and crank mechanism of the doll of FIG. 1.

A segmented input drive gear 152 is connected by a square shaft (not shown) to a crank arm 154, mounted on the outside of the righthand plate **156*r* as shown in FIG. 8. The crank arm 154 carries an enlarged push plate 164** at its lowermost end which engages the inner wall of the front surface of the torso as shown in FIGS.

4 and 5. A second stabilizing plate 166 is secured to the drive means and engages the inside of the rear wall of the torso as shown in FIGS. 4–6. Thus, the crank arm 154 and the drive means 34 are actuated by squeezing the exterior of the torso to move the crank arm 154 rearwardly toward the back plate 166 as shown by arrow A in FIG. 5.

The crank arm 154 is biased to its forwardmost position as shown in FIG. 5 by a spring 170 which is secured on one end to the plate 156*r* by a post 172. The opposite end of the spring 170 is connected to an offset arm 174 secured on the same square shaft by means such as the screw 176. Thus, the spring 170 will always return the crank arm 154 to its forwardmost position.

Referring now to FIG. 7, and in particular to the gear train 150, the segmented gear 152 engages a pinion gear 180 as indicated by the dotted line, which is conjointly rotatably mounted by a larger intermediate gear 182 on a horizontal shaft 184. The righthand reduced end 186 of the shaft 184 fits loosely within an aperture in the left side plate 156L while the righthand reduced end of the shaft 184 rides within an arcuate slot 188 in the right plate 156R (FIGS. 4 and 7). This mounting arrangement for the shaft 184 provides for a disengagement of the drive mechanism as will be described in greater detail hereinafter. The larger intermediate gear 182 engages a rearwardly mounted pinion gear 190 which is conjointly rotatably mounted by a horizontal shaft 194 extending between apertures in the plates 156. The output drive wheel 140 is mounted on the left end of the shaft 194, on the exterior side of the left plate 156L as shown clearly in FIG. 6. The large gear 192 further meshingly engages a pinion gear 196 on an upper shaft 198 which carries an additional large gear 200. The large gear 200 finally engages a generally elongated pinion gear 202 mounted by a shaft 204. The righthand end of the shaft 204 extends outwardly through the plate 156R to a governor mechanism, generally designated 206 (FIG. 8). The governor mechanism 206 includes a rotating mass 210 secured to the shaft 204. Two generally arcuate shaped weighted elements 212 are secured at one of their ends to the weighted mass 204 by a reduced area portion 214. This reduced area portion 214 permits the arcuate weighted portions 212 to flex outwardly under the influence of centrifugal forces during rotation. As can be seen from the gear train, the pinion gear 202 will rotate at a substantially faster rate than the input gear 152 and also at a faster rate than the output wheel 140 by virtue of the relationship of the sizes of the gears. Therefore, the arcuate weighted portions 212 will flex outwardly when the crank 154 is operated. The rotating mass 210 is surrounded by a solid, generally cylindrical drum portion 218 which acts as a friction or bearing surface for the outwardly flexed arcuate weighted portions 212 and thus provides sufficient friction to permit actuation of the drive means, and movement of the crank arm 154 at only an upper predetermined speed limit.

The relationship between the sizes of the gears in the drive means is set up so that movement of the crank arm 154 from its position as shown in FIG. 5 to its position as shown in FIG. 6 will positively drive the output wheel 140 from a position, generally as shown in FIG. 7, with the mouth in a closed position through an arc of 360°. The momentum and backlash within the gear train will permit the output wheel 140 to continue to rotate approximately 180° to a final position as shown in FIG. 6 with the connecting pin 136 at a low point when the mouth is moved to the open position. Thereafter, the spring 114 applies tension on the string 124 to rotate the output wheel 140 in the opposite direction approximately 180°, thus permitting the mouth to close. Therefore, in one operation of the crank arm 154, the output gear 140 rotates in a clockwise direction as shown by arrow B approximately 540° and then in a counterclockwise direction approximately 180° so that the mouth ends up in a closed position. As described above with respect to the sounding means 30, the "mama" sound is produced in a timed relationship with the movement of the lips. Alternatively, the output gear 140 could be positively driven through the 540° arcuate path, in which case, the mouth would remain in its open position as long as pressure were maintained on the forward plate 164.

The gear train is designed with the clutch mechanism provided by the slot 188 so that the mouth does not open and close when the crank arm 154 moves back to its forwardmost position under the influence of the return spring 170. Referring particularly to FIG. 7, when the segmented gear 152 rotates in a clockwise direction as shown by arrows C, to return the crank arm 154, the tangential force applied to the pinion gear 180 causes the shaft 184 to pivot forwardly about the reduced end 186 as the opposite end slides forwardly in the slot 188. This permits the larger intermediate gear 182 to become disengaged with the pinion gear 190 and thus the remainder of the drive train is not driven in a rearward direction.

The clutch engagement mechanism provided by the slot 188 is utilized to operate the doll in its second mode of operation. In this mode of operation, the doll is held against the body of a user, similar to the conventional hugging position when it is desirable to pat the child on the back. In this position, due to the force of gravity and the weight of the shaft 184 and gears 182 and 180, the shaft 184 will again pivot forwardly since, in this position, the slot 188 will be generally downwardly directed. Thus, the gear train will again be disengaged and when pressure is applied on the back of the doll to move the crank arm 154 between its positions as shown in FIGS. 5 and 6, the mouth moving mechanism will not be operated since the drive train to the output gear 140 has been disconnected. However, the compression of the torso still causes pressurized air to be supplied through the inlet tube 62 to the chamber 58 and through the reed 82 while the pad 112 is maintained in a position generally flush against the sound emanating orifice. Therefore, the sound produced by pressurized air passing through the reed escapes as it is forced past the resilient pad 112 but the sound which is produced is very muffled and resembles a humming or purring sound as a child may do prior to falling asleep.

Thus, with the sounding means provided and the drive means as described in detail, the animated doll of the present invention can be used to produce a "mama" sound in a timed coordinated relationship with the movement of its lips. In addition, by virtue of the disengagement mechanism, other sounds can be made, depending upon the rate of compression of the torso, without any associated lip movement. Because the facial features and in fact the entire head portion of the doll is preferably made of soft pliable or flexible material, additional facial portions such as the cheeks, chin and nose of the doll will also be moved as a result of the movement of the lips, is normally associated with human talking. Obviously, many minor alterations, such as changing the gear ratios of the drive train or the provision of different reeds within the sounding means can accomplish many different modes of operation of the doll and sounds to be produced by the doll. All of these additional modes are deemed to be contemplated by the present invention and the foregoing detailed description has been given for clearness of understanding only and no unnecessary limitations should be understood therefrom as many modifications will be obvious to those skilled in the doll art.

I claim:

1. An animated talking doll, comprising:

a doll body having a head and a movable mouth defined thereon;

sounding means within the doll body including means responsive to the passage of air for generating an audible sound;

a manually operable air pump within said body communicating with said sounding means;

manually operable means within said body for manipulating said mouth including a pivotal member and a reducing gear train, said pivotal member operatively connected to said reducing gear train, said gear train including means for converting a single pivotal movement of said member into at least two opening and two closing movements of said mouth; and a scissors mechanism operatively connected to open and close said mouth, said scissors mechanism connected to said gear train and including an extension arranged to control the air flow through said sounding means.

2. The doll of claim 1 including a clutch means responsive to the position of said doll for deactivating said gear train.

* * * * *